US011205869B2

(12) United States Patent
Lee et al.

(10) Patent No.: US 11,205,869 B2
(45) Date of Patent: Dec. 21, 2021

(54) CONNECTOR AND MANUFACTURING METHOD THEREOF

(71) Applicants: HYUNDAI MOTOR COMPANY, Seoul (KR); KIA MOTORS CORPORATION, Seoul (KR); KUM CO., LTD., Ulsan (KR)

(72) Inventors: Cheolhun Lee, Suwon-si (KR); Jihoon Kim, Daegu (KR); Young Joo Yun, Ulsan (KR); Seung Myeon Bae, Hwaseong-si (KR); Dong Hoon Lee, Ulsan (KR)

(73) Assignees: HYUNDAI MOTOR COMPANY, Seoul (KR); KIA MOTORS CORPORATION, Seoul (KR); KUM CO., LTD., Ulsan (KR)

( * ) Notice: Subject to any disclaimer, the term of this patent is extended or adjusted under 35 U.S.C. 154(b) by 0 days.

(21) Appl. No.: 16/921,452

(22) Filed: Jul. 6, 2020

(65) Prior Publication Data

US 2021/0083419 A1 Mar. 18, 2021

(30) Foreign Application Priority Data

Sep. 18, 2019 (KR) ..... 10-2019-0114628

(51) Int. Cl.

| | |
|---|---|
| ***H01R 13/46*** | (2006.01) |
| ***H01R 13/05*** | (2006.01) |
| ***H01R 13/652*** | (2006.01) |
| ***H01R 43/16*** | (2006.01) |
| ***H01R 43/18*** | (2006.01) |
| ***H01R 25/16*** | (2006.01) |

(52) U.S. Cl.

CPC ..... *H01R 13/465* (2013.01); *H01R 13/05* (2013.01); *H01R 13/652* (2013.01); *H01R 25/162* (2013.01); *H01R 43/16* (2013.01); *H01R 43/18* (2013.01)

(58) Field of Classification Search

CPC .... H01R 13/465; H01R 13/05; H01R 13/652; H01R 13/6273; H01R 25/162; H01R 43/16; H01R 43/18

USPC ..... 439/152, 540.1

See application file for complete search history.

(56) References Cited

U.S. PATENT DOCUMENTS 4,596,436 A * 6/1986 Kraemer ..... H01R 13/64 439/680
4,915,641 A * 4/1990 Miskin ..... H01R 13/631 439/247
5,314,357 A * 5/1994 Weidler ..... H01R 13/518 439/680

(Continued)

*Primary Examiner* — Peter G Leigh

(74) *Attorney, Agent, or Firm* — McDonnell Boehnen Hulbert & Berghoff LLP

(57) ABSTRACT

Disclosed are a connector and a manufacturing method thereof. The connector includes a female housing, one or more first female terminals installed in the female housing, a plurality of second female terminals installed side by side with the first female terminals in the female housing and connected to wires, a first terminal holder having a plurality of terminal grooves to allow the one or more first female terminals to be selectively coupled thereto, the first terminal holder being fastened to the female housing in a state in which the first female terminals are coupled, and a bus bar installed in the first terminal holder to allow one of the one or more first female terminals installed in the plurality of terminal grooves and the second female terminals to be connected thereto.

7 Claims, 13 Drawing Sheets

(56) References Cited

U.S. PATENT DOCUMENTS 5,403,204 A * 4/1995 Chishima ..... H01R 13/4223 439/189
5,443,403 A * 8/1995 Weidler ..... H01R 13/518 439/557
5,556,301 A * 9/1996 Chishima ..... H01R 13/53 439/101
5,741,147 A * 4/1998 Konoya ..... H01R 31/08 439/189
5,749,753 A * 5/1998 Chishima ..... H01R 13/113 439/752.5
6,183,299 B1 * 2/2001 Ward ..... H01R 13/4223 439/595
6,305,986 B1 * 10/2001 Hwang ..... H01R 13/6485 439/358
6,645,003 B2 * 11/2003 Yoshida ..... H01R 13/514 439/507
7,156,704 B2 * 1/2007 Shimizu ..... H01R 13/113 439/852
7,198,354 B2 * 4/2007 Silverbrook ..... B41J 2/14427 347/42
7,198,355 B2 * 4/2007 Silverbrook ..... B41J 2/14427 347/49
7,429,095 B2 * 9/2008 Silverbrook ..... B41J 2/14427 347/42
7,448,908 B2 * 11/2008 Iwahori ..... H01R 13/5219 439/587
7,530,861 B2 * 5/2009 Nakamura ..... H01R 13/6633 439/854
7,883,362 B2 * 2/2011 Ichio ..... H01R 31/08 439/511
8,430,692 B2 * 4/2013 Peng ..... H01R 13/518 439/607.46
8,882,545 B2 * 11/2014 Vroom ..... H01R 13/60 439/639
9,124,016 B2 * 9/2015 Omori ..... H01R 13/5208
9,172,193 B2 * 10/2015 Sakamoto ..... H01R 31/08
9,397,452 B1 * 7/2016 Fan ..... H01R 31/08
2016/0190722 A1 * 6/2016 Nagasawa ..... H01R 13/50 439/660
2017/0040731 A1 * 2/2017 Nishiyama ..... H01R 13/41
2018/0090896 A1 * 3/2018 Washio ..... H01R 31/08
2019/0109417 A1 * 4/2019 Tsukamoto ..... H01R 13/7193

* cited by examiner

| CLASIFICATION | GROUNDING PATTERN | WIRING CIRCUIT |
|---|---|---|
| PATTERN 1 |  |   |
| PATTERN 2 |  |   |
| PATTERN 3 |  |   |
| PATTERN 4 |  |   |
| PATTERN 5 |  |   |
| PATTERN 6 |  |   |
| PATTERN 7 |  |   |
| PATTERN 8 |  |   |

CONNECTOR AND MANUFACTURING METHOD THEREOF

CROSS REFERENCE TO RELATED APPLICATIONS

This application is based on and claims priority under 35 U.S.C. § 119 to Korean Patent Application No. 10-2019-0114628, filed on Sep. 18, 2019, in the Korean Intellectual Property Office, the disclosure of which is incorporated by reference herein in its entirety.

BACKGROUND

1. Field

The disclosure relates to a connector capable of reducing manufacturing costs and improving the workability of wiring by reducing the number of wires to be connected and capable of easily changing the grounding pattern, and a manufacturing method thereof.

2. Description of Related Art

Electrical components installed in a vehicle are connected to wires for signal transmission, grounding, and power supply by connectors. For example, a sensor installed in a vehicle has a plurality of connection pins, and the connection pins are connected to the plurality of wires by a connector having a plurality of terminals.

Because many terminals of a connector are each connected to a wire, the number of wires connected to the connector is large, thereby making wiring work difficult. In addition, the connector not only requires a large number of parts for connecting each electric wire and each terminal, and a large number of sealing members installed for each electric wire, but the assembly process is complicated, thereby increasing the manufacturing cost.

SUMMARY

It is an aspect of the disclosure to provide a connector capable of reducing manufacturing costs and improving the workability of wiring by reducing the number of wires to be connected, and a manufacturing method thereof.

It is another aspect of the disclosure to provide a connector capable of easily changing and diversifying the grounding pattern of electrical components to be connected to the connector, and a manufacturing method thereof.

Additional aspects of the disclosure will be set forth in part in the description which follows and, in part, will be obvious from the description, or may be learned by practice of the disclosure.

In accordance with an aspect of the disclosure, a connector includes a female housing, one or more first female terminals installed in the female housing, a plurality of second female terminals installed side by side with the first female terminals in the female housing and connected to wires, a first terminal holder having a plurality of terminal grooves to allow the one or more first female terminals to be selectively coupled thereto, the first terminal holder being fastened to the female housing in a state in which the first female terminals are coupled, and a bus bar installed in the first terminal holder to allow one of the one or more first female terminals installed in the plurality of terminal grooves and the second female terminals to be connected thereto.

The connector may further include a second terminal holder installed in the female housing and configured to support the plurality of second female terminals.

The first terminal holder and the second terminal holder may be installed side by side to be in contact with each other, and one of the second female terminals connected to the bus bar may be installed between the first terminal holder and the second terminal holder.

The bus bar may include a plurality of first connection portions elastically deformed in contact with outer surfaces of the first female terminals coupled to the plurality of terminal grooves, a second connection portion elastically deformed in contact with one of the second female terminals, and a connection part connecting the plurality of first connection portions and the second connection portions.

Each of the first female terminals may include a locking groove caught on and supported by a locking protrusion provided on an inner surface of each of the terminal grooves.

Each of the first female terminals may enter the terminal grooves from an entry end of the first terminal holder first entering into the female housing, and an end thereof exposed to the outside of the entry end of the first terminal holder may be supported on an inner surface of the female housing.

In accordance with another aspect of the disclosure, a method of manufacturing the connector includes installing the bus bar in the first terminal holder, selectively installing the first female terminal in at least one of the plurality of terminal grooves of the first terminal holder according to a grounding pattern, and coupling the first terminal holder in which the bus bar and the first female terminals are assembled to the female housing and connecting the bus bar to one of the second female terminals.

The first terminal holder may be manufactured in a different color according to the grounding pattern to easily identify the grounding pattern according to a change in the number and position of the first female terminals installed in the plurality of terminal grooves.

BRIEF DESCRIPTION OF THE FIGURES

These and/or other aspects of the disclosure will become apparent and more readily appreciated from the following description of the embodiments, taken in conjunction with the accompanying drawings of which.

DETAILED DESCRIPTION

Hereinafter embodiments of the disclosure will be described in detail with reference to the accompanying drawings. The embodiments described below are provided by way of example so that those skilled in the art will be able to fully understand the spirit of the disclosure. The disclosure is not limited to the embodiments described below, but may be embodied in other forms. In order to clearly explain the disclosure, parts not related to the description are omitted from the drawings, and the width, length, thickness, etc. of the components may be exaggerated for convenience.

Figure 1:
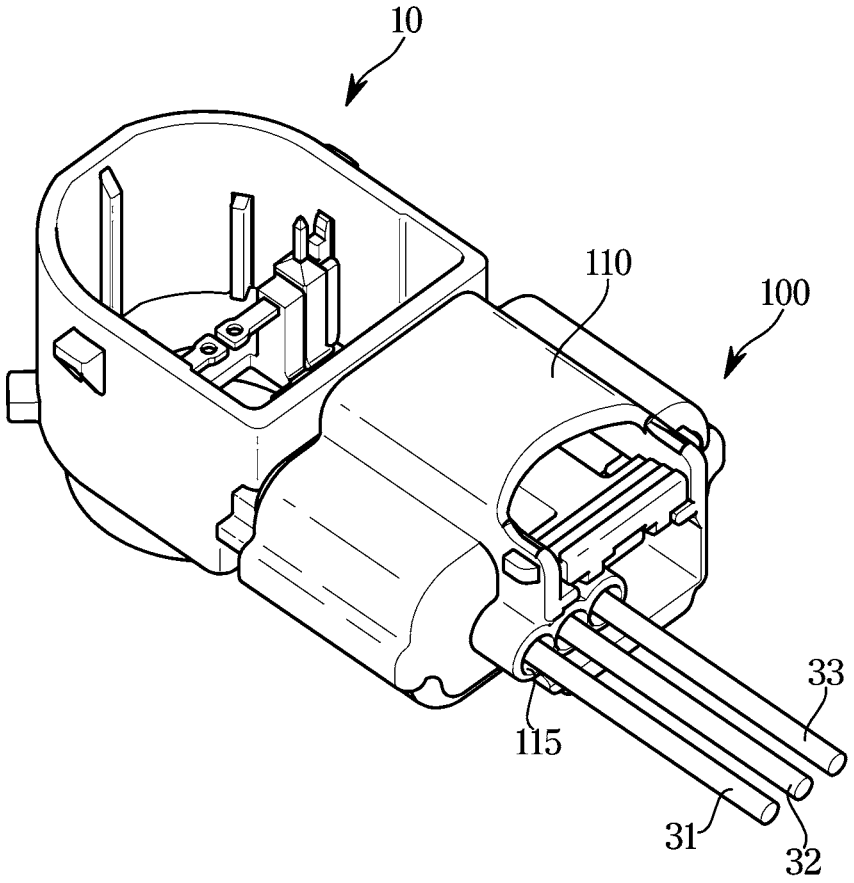
FIG. 1 is a perspective view illustrating a state in which a connector according to an embodiment of the disclosure is connected to a sensor.
Figure 2:
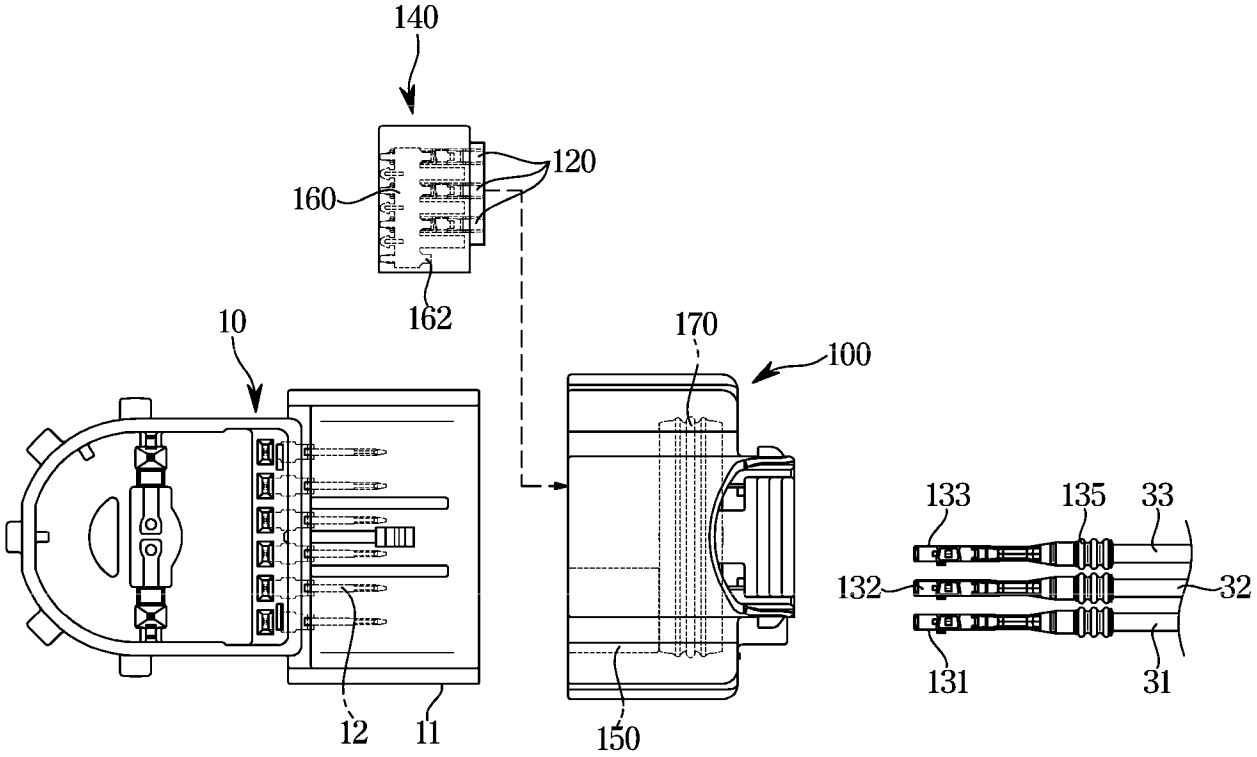
FIG. 2 is a plan view illustrating a configuration of the connector and the sensor according to an embodiment of the disclosure.

Referring to FIGS. 1 and 2, a connector 100 according to an embodiment of the disclosure may be coupled to a connection part 11 of a sensor 10 provided with a plurality of male terminals 12 (connection pins) to connect wires 31, 32, and 33 for signal transmission, grounding and power supply to male terminals 12 of the sensor 10.

Figure 3:
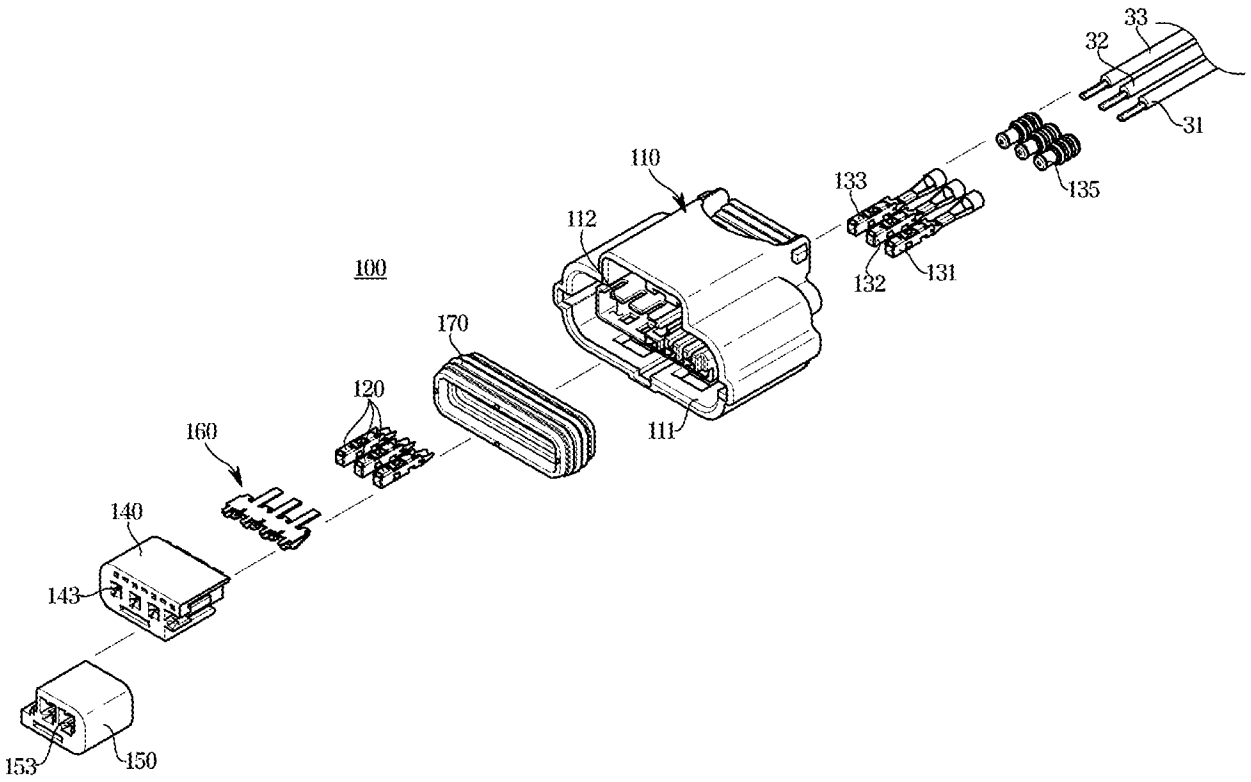
FIG. 3 is an exploded perspective view of the connector according to an embodiment of the disclosure.

Referring to FIGS. 2 and 3, the connector 100 may include a female housing 110, one or more first female terminals 120, a plurality of second female terminals 131, 132, and 133, a first terminal holder 140, a second terminal holder 150, a bus bar 160, and a sealing member 170.

The female housing 110 includes a connection space 112 having an open front surface 111 such that the connection part 11 of the sensor 10 enters and is connected thereto. The sealing member 170, the first terminal holder 140, and the second terminal holder 150 may be configured to enter into the connection space 112 through the open front surface 111 of the female housing 110.

The second female terminals 131, 132, and 133 may be configured to enter into the connection space 112 through electric wire entrance holes 115 (see FIG. 1) formed at a rear surface of the female housing 110 in a state of being connected to the wires 31, 32, and 33, respectively. Wire sealing members 135 of an elastic material for sealing the electric wire entrance holes 115 of the female housing 110 to prevent permeation of moisture or foreign matter may be installed on outer surfaces of the wires 131, 132, and 133, respectively.

The bus bar 160 and the one or more first female terminals 120 may be installed in the female housing 110 when assembled to the first terminal holder 140. The first female terminals 120 are not directly connected to the wires 31, 32, and 33. The first female terminals 120 are connected to one of the second female terminals 131, 132, and 133 through the bus bar 160 when the first terminal holder 140 enters and is coupled to the female housing 110. In the present embodiment, the bus bar 160 is connected to one second male terminal 133 connected to the grounding wire 33.

Figure 4:
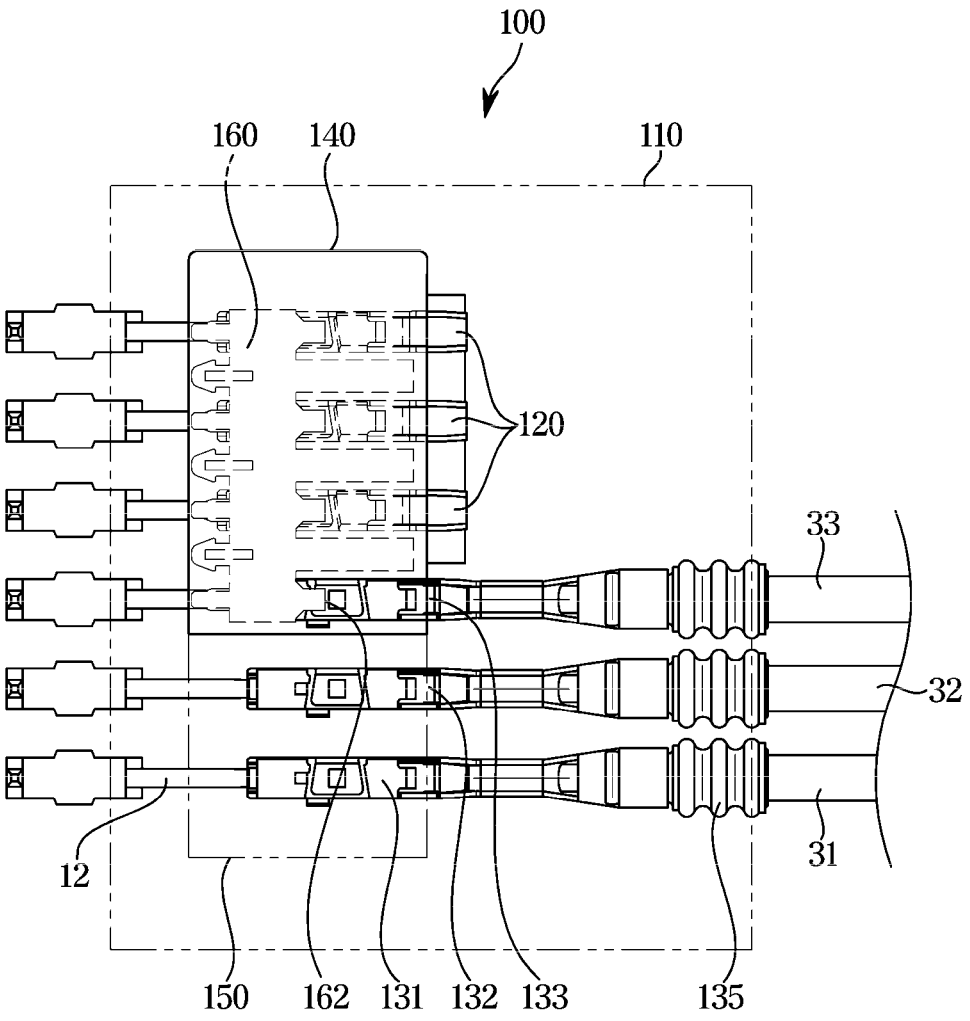
FIG. 4 illustrates a state in which first and second female terminals of the connector according to an embodiment of the disclosure are connected to male terminals of the sensor.

Referring to FIG. 4, the wires 31, 32, and 33 may be composed of the power wire 31, the signal wire 32, and the grounding wire 33, respectively, and the second female terminals 131, 132, and 133 may be installed side by side in the female housing 110 when connected to the power wire 31, the signal wire 32, and the grounding wire 33, respectively. The first female terminals 120 may also be installed side by side at equal intervals on sides of the second female terminals 131, 132, and 133 in the female housing 110. The second female terminal 133 connected to the grounding wire 33 is disposed adjacent to the first female terminals 120.

Figure 5:
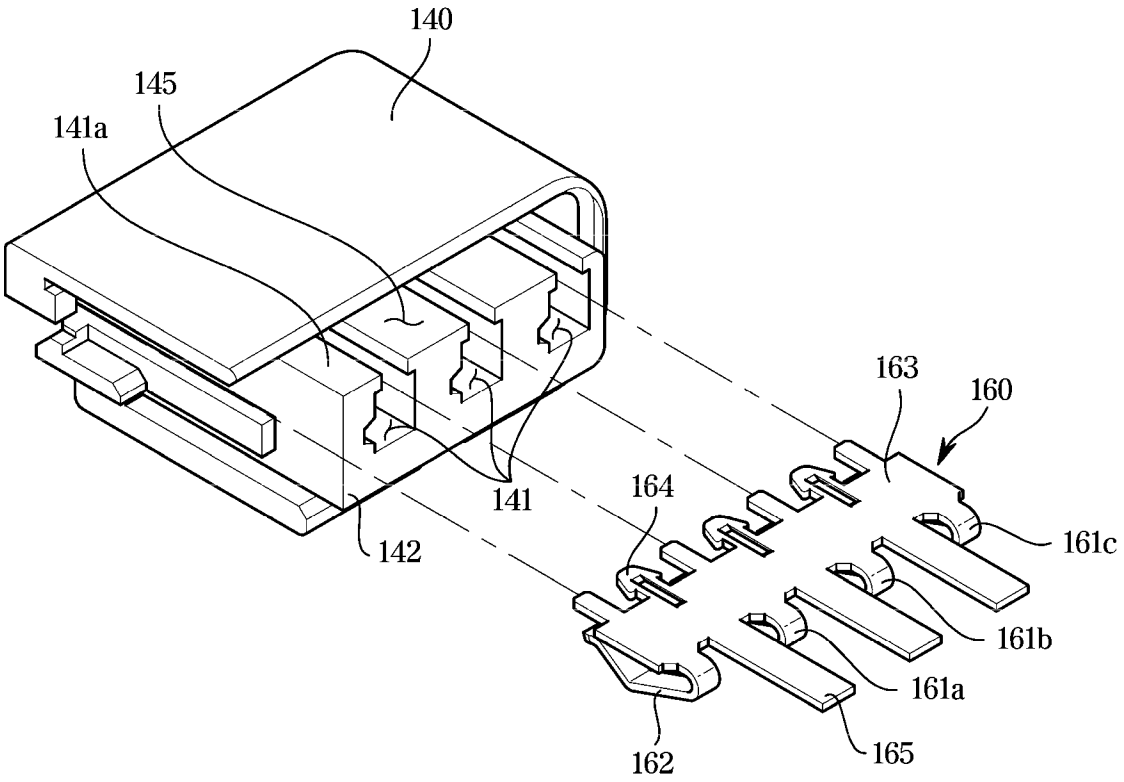
FIG. 5 is a perspective view illustrating a first terminal holder and a bus bar of the connector according to an embodiment of the disclosure.
Figure 6:
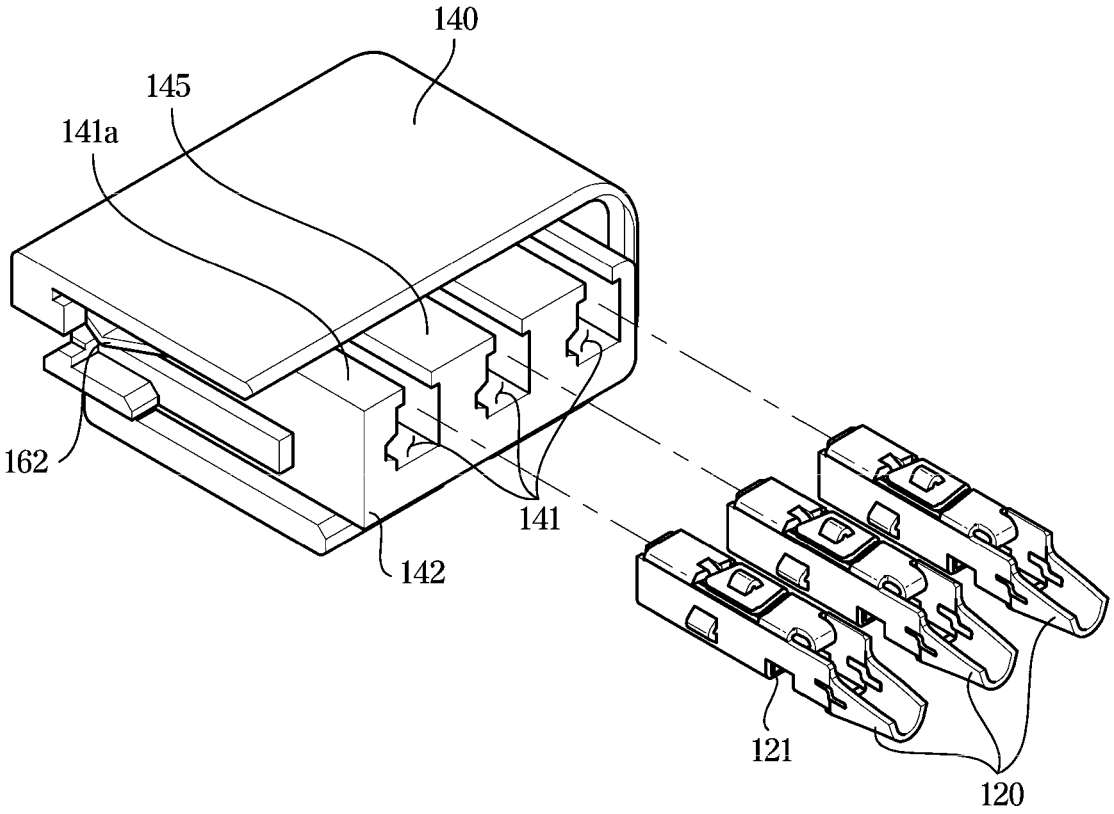
FIG. 6 is a perspective view illustrating the first terminal holder and the first female terminals of the connector according to an embodiment of the disclosure.
Figure 7:
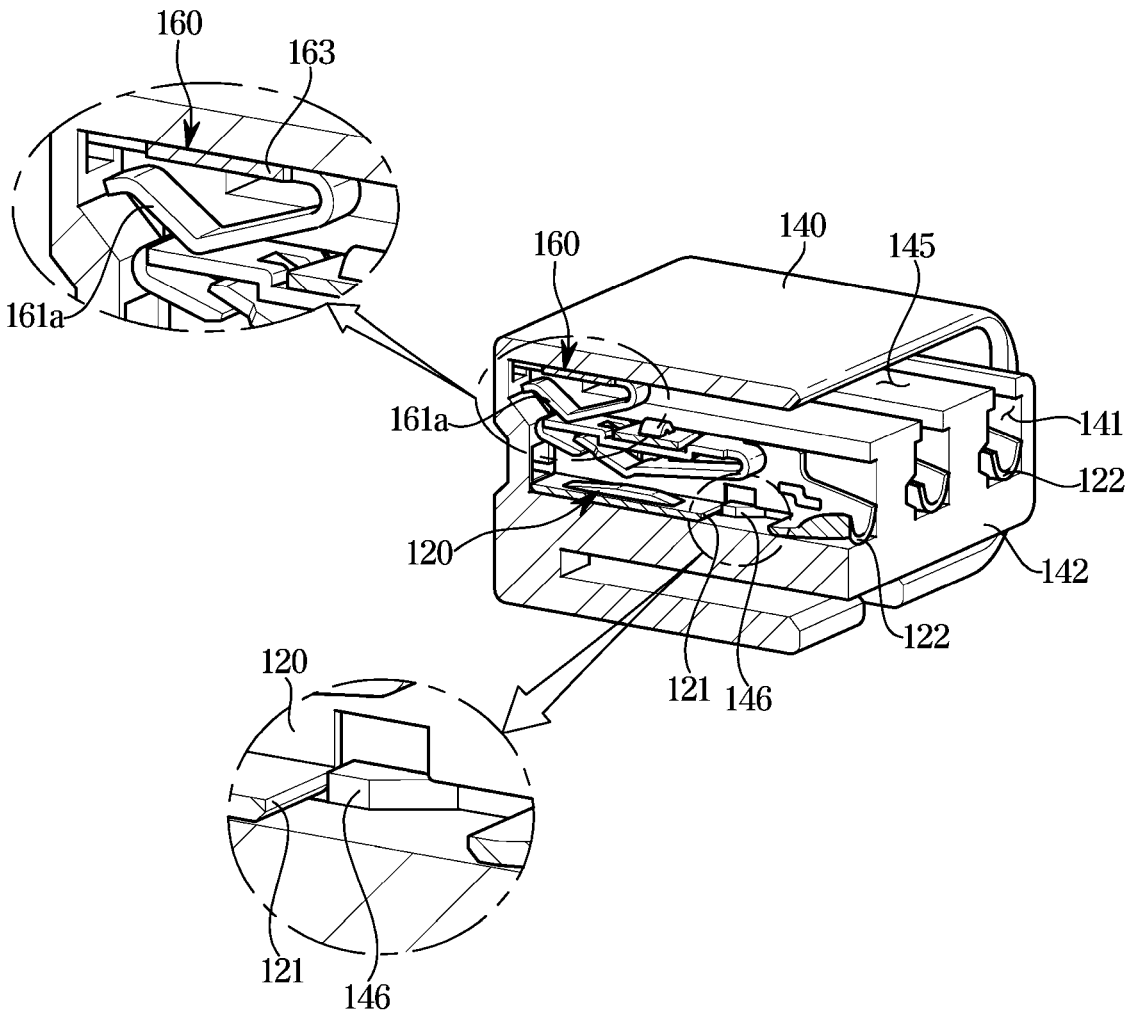
FIG. 7 is a cutaway perspective view illustrating a state in which the bus bar and the first female terminals are coupled to the first terminal holder of the connector according to an embodiment of the disclosure.

As illustrated in FIGS. 5 to 7, the first terminal holder 140 may be provided in a block form and include a plurality of terminal grooves 141 to which one or more of the first female terminals 120 may be selectively coupled. The first terminal holder 140 of the present embodiment includes three of the terminal grooves 141 such that the three of the first female terminals 120 may be installed side by side, but the number of the terminal grooves 141 may be changed according to design.

Figure 8:
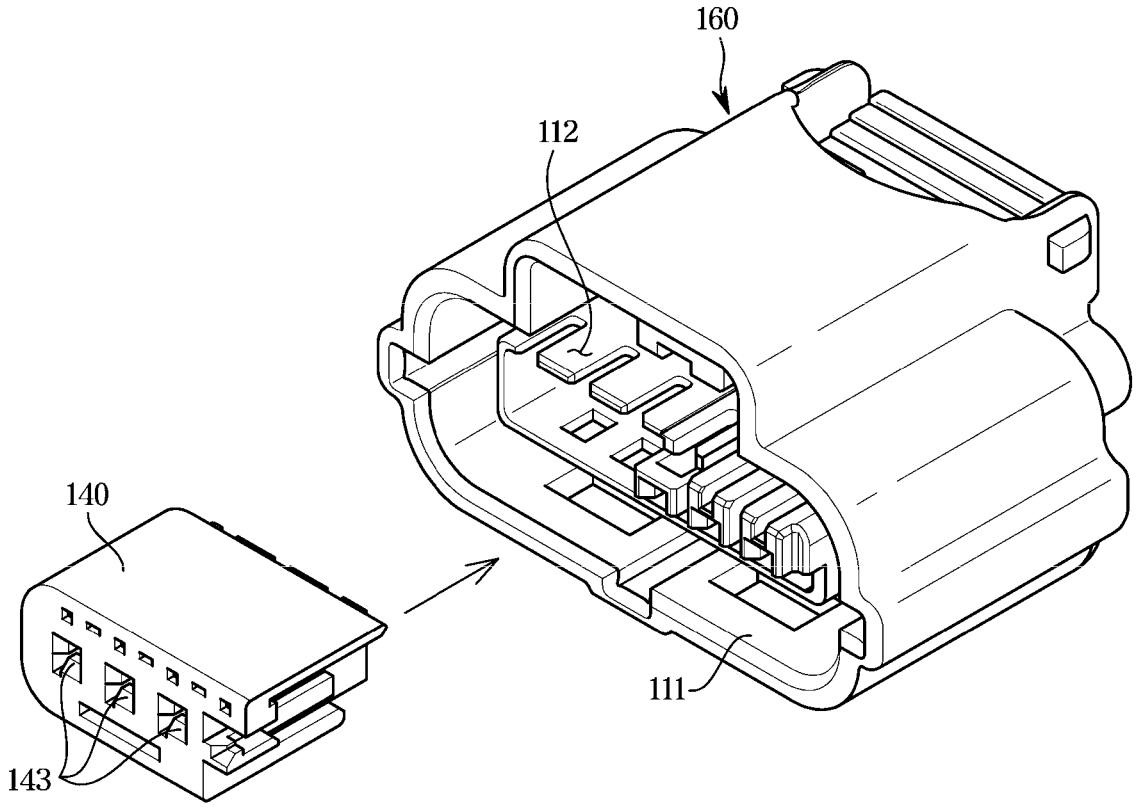
FIG. 8 is a perspective view illustrating a coupling relationship between a female housing and the first terminal holder of the connector according to an embodiment of the disclosure.
Figure 10:
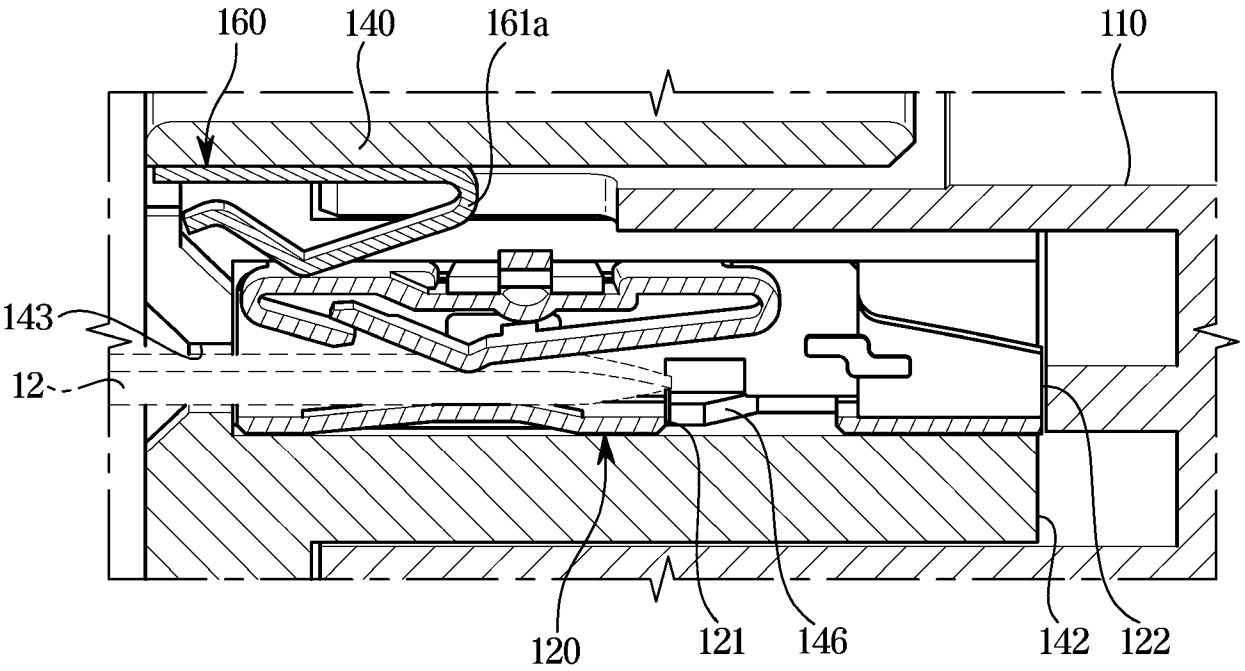
FIG. 10 is a detail view of a part X of FIG. 9.

The terminal grooves 141 extend in a direction in which the connector 100 is connected or disconnected. Accordingly, as illustrated in FIG. 6, each of the first female terminals 120 may be configured to enter into each of the terminal grooves 141 from an entry end 142 side of the first terminal holder 140 entered into the female housing 110. As illustrated in FIGS. 8 and 10, a plurality of holes 143 are provided on the opposite side of the entry end 142 of the first terminal holder 140 such that a plurality of male terminals 12 (connection pins) of the sensor 10 may enter into the respective terminal grooves 141 to be connected to the first female terminals 120.

As illustrated in FIG. 5, the first terminal holder 140 includes a bus bar installation groove 145 formed above the terminal grooves 141 to install the bus bar 160. The terminal grooves 141 include a cutting groove 141*a* formed in a longitudinal direction at an upper side thereof to communicate with the bus bar installation groove 145.

As illustrated in FIG. 5, the bus bar 160 includes a plurality of first connection portions 161*a*, 161*b*, and 161*c* electrically connected and elastically deformed in contact with outer surfaces of the first female terminals 120 coupled to the plurality of terminal grooves 141, a second connection portion 162 in contact with the second female terminal 133 to be electrically connected thereto and elastically deformed, and a connection portion 163 extending in a transverse direction to connect the second connection portion 162 to the plurality of first connection portions 161*a*, 161*b*, and 161*c*. The bus bar 160 may include a plurality of coupling portions 164 entering into and coupled to the bus bar installation groove 145 of the first terminal holder 140, and a plurality of support portions 165 extending in the opposite direction of the coupling portions 164 to be supported inside the female housing 110.

The plurality of first connection portions 161*a*, 161*b*, and 161*c*, the second connection portion 162, the plurality of coupling portions 164 and the plurality of support portions 165 may be integrally formed by cutting and bending molding of a metal sheet such as copper. As illustrated in FIG. 5, the bus bar 160 may be assembled by entering the bus bar installation groove 145 from the entry end 142 of the first terminal holder 140. The plurality of first connection portions 161*a*, 161*b*, and 161*c* may be connected to the first female terminals 120 installed in the terminal grooves 141, respectively, by entering through the cutting groove 141*a* formed at the upper side of the terminal grooves 141.

As illustrated in FIGS. 6 and 7, the plurality of first female terminals 120 may be installed in the first terminal holder 140 by entering into the respective terminal grooves 141 after the bus bar 160 is first installed in the first terminal holder 140. As such, as illustrated in FIG. 7, when the first female terminals 120 are installed in the first terminal holder 140, the first connection portions 161*a*, 161*b* and 161*c* of the bus bar 160 may be elastically deformed to press upper surfaces of the first female terminals 120.

As illustrated in FIG. 7, each of the terminal grooves 141 is provided with a locking protrusion 146 protruding from an inner surface thereof to restrain each of the first female terminals 120 entered into the inside thereof, and each of the first female terminals 120 includes a locking groove 121 caught on and supported by the locking protrusion 146 in the state of entering each of the terminal grooves 141. Therefore, the first female terminals 120 may maintain a stable connection to the first connection portions 161*a*, 161*b*, and 161*c* of the bus bar 160 without being separated from the first terminal holder 140 after being coupled.

Figure 9:
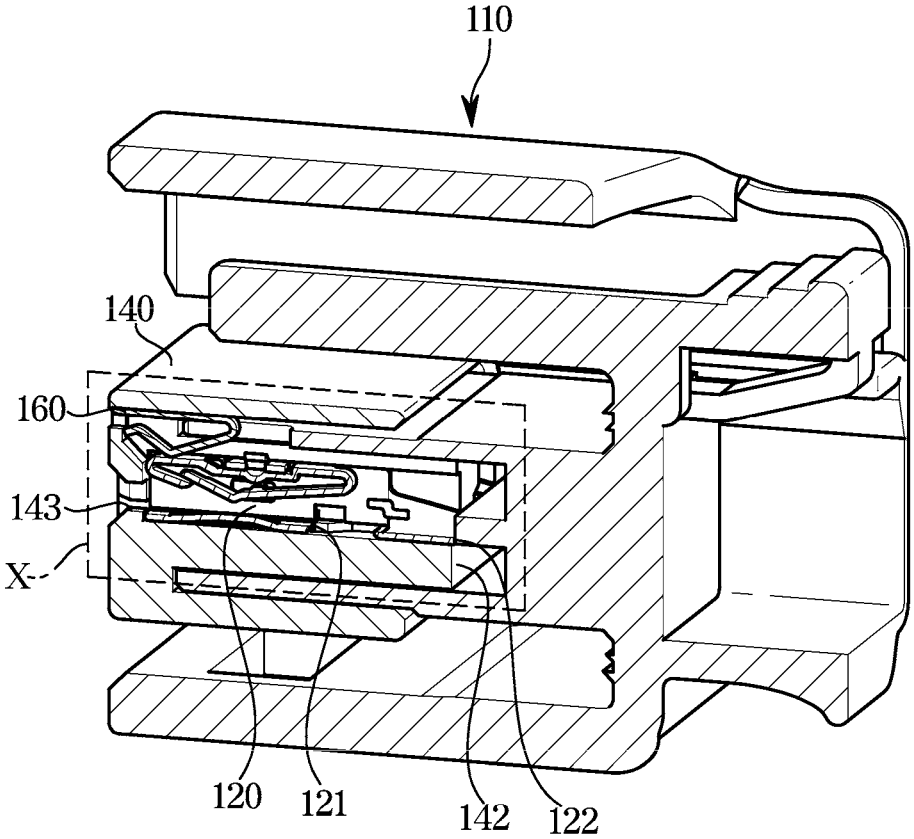
FIG. 9 is a cutaway perspective view of the female housing to which the first terminal holder of the connector according to an embodiment of the disclosure is coupled.

As illustrated in FIG. 8, the first terminal holder 140 in which the bus bar 160 and the one or more first female terminals 120 are assembled may be installed to enter into the connection space 112 through the open front surface 111 of the female housing 110. As such, when the first terminal holder 140 is coupled to the female housing 110, as illustrated in FIGS. 9 and 10, an end 122 of the first female terminal 120 slightly exposed to the outside of the entry end 142 of the first terminal holder 140 is supported on the inner surface of the female housing 110. Therefore, even when the male terminal 12 of the sensor 10 is connected by entering the first female terminal 20 or reversely disconnected, the first female terminals 120 may be stably supported in the female housing 110 without shaking.

Figure 11A:
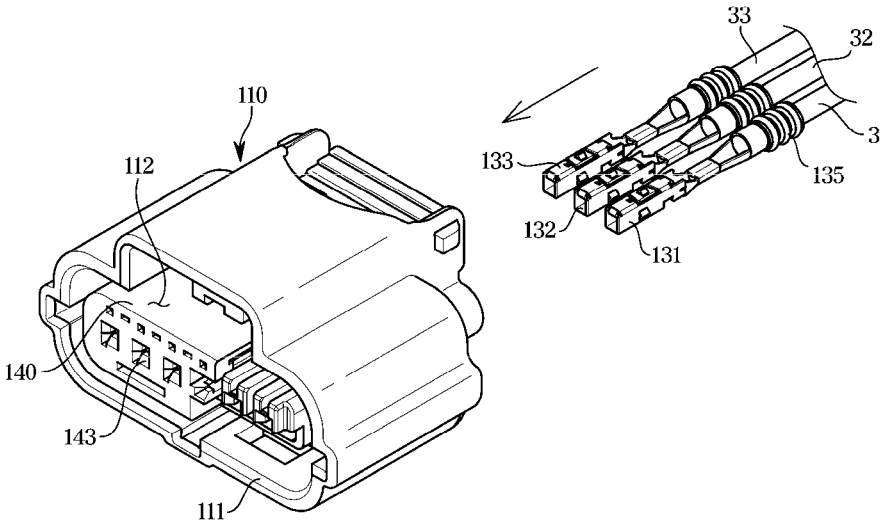
FIGS. 11A, 11B, and 11C are perspective views illustrating assembly processes of second female terminals and a second terminal holder of the connector according to an embodiment of the disclosure, in phases.
Figure 11B:
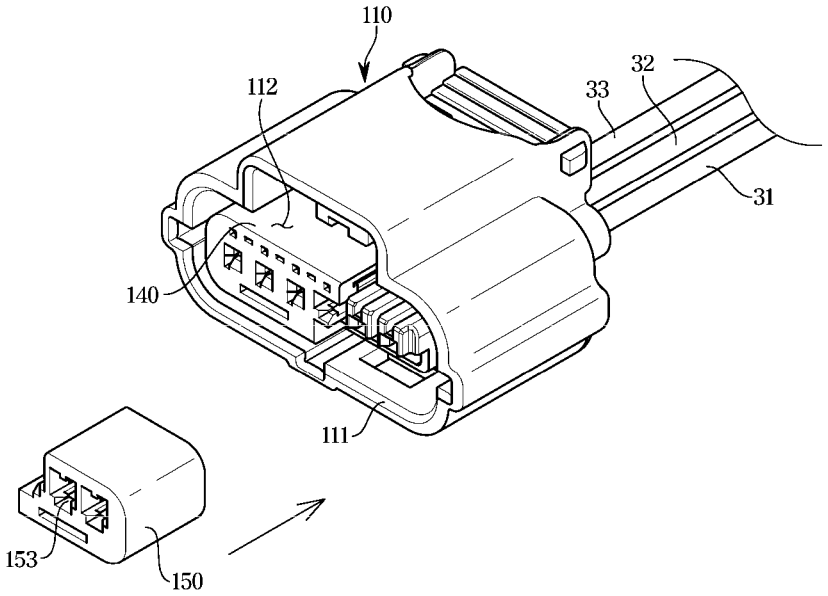
Figure 11C:
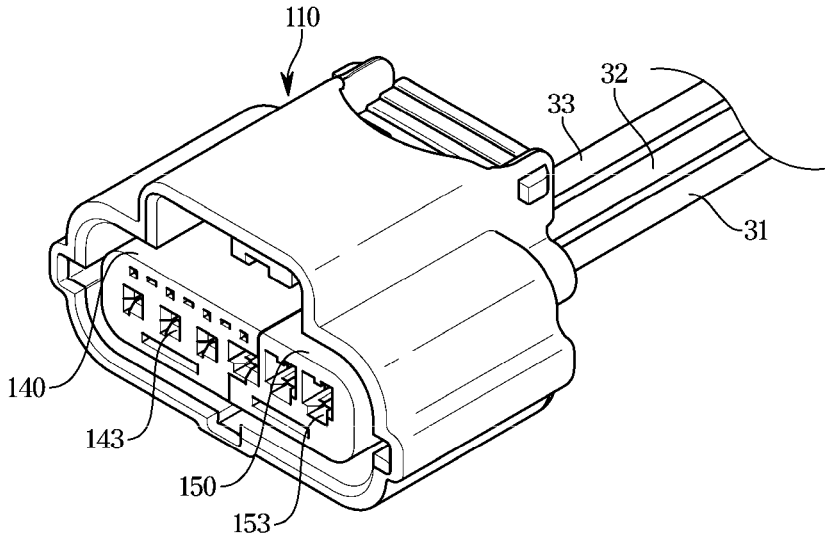

FIGS. 11A to 11C are perspective views illustrating assembly processes of the second female terminals 131, 132, and 133, and the second terminal holder 150 in phases. Referring to FIG. 11A, the plurality of second female terminals 131, 132, and 133 may be installed in the female housing 110 after the first terminal holder 140 in which the bus bar 160 and the one or more first female terminals 120 are assembled is coupled to the female housing 110. The plurality of second female terminals 131, 132, 133 may be coupled to the female housing 110 in a state of being connected to the power wire 31, the signal wire 32, and the grounding wire 33, respectively, and the wire sealing members 135 may be installed on the power wire 31, the signal wire 32, and the grounding wire 33, respectively.

As illustrated in FIGS. 11B and 11C, after the second female terminals 131, 132, 133 are installed in the female housing 110, the second terminal holder 150 is installed to enter into the female housing 110 from the open front surface 111 of the female housing 110 so that the second female terminals 131, 132, 133 are stably fixed.

As illustrated in FIG. 11C, the first terminal holder 140 and the second terminal holder 150 are installed side by side to be in contact with each other in the female housing 110. The second terminal holder 150 includes a plurality of terminal grooves supporting the second female terminal 150, and a front surface of the second terminal holder 150 is provided with holes 153 for entry of the male terminal 12 of the sensor 10.

When the second terminal holder 150 is installed as in the example of FIG. 11C, as illustrated in FIG. 4, the second female terminal 133 connected to the grounding wire 33 is positioned between the first terminal holder 140 and the second terminal holder 150 to be connected to the second connection portion 162 of the bus bar 160 fixed to the first terminal holder 140. Accordingly, all of the first female terminals 120 installed in the first terminal holder 140 may be connected to the grounding wire 33 through the bus bar 160. For this connection, the first terminal holder 140 and the second terminal holder 150 may form a terminal groove supporting the second female terminal 133 connected to the grounding wire 33 through mutual coupling.

Figure 12:
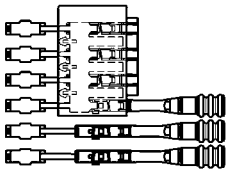
FIG. 12 illustrates an example in which the grounding pattern is variously changed according to the number and position of the first female terminals assembled to the first terminal holder of the connector according to an embodiment of the disclosure.
Figure 12:
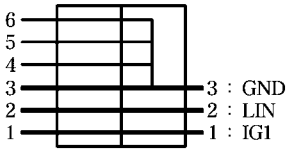
Figure 12:
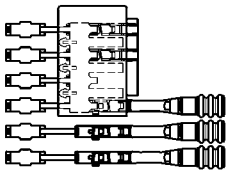
Figure 12:
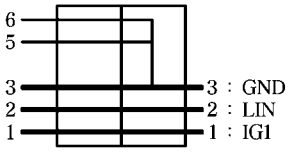
Figure 12:
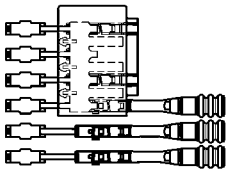
Figure 12:
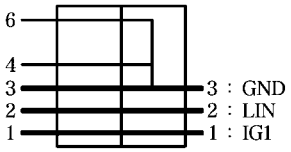
Figure 12:
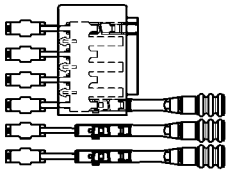
Figure 12:
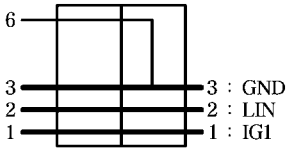
Figure 12:
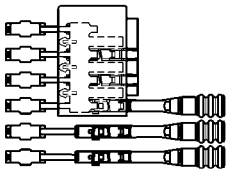
Figure 12:
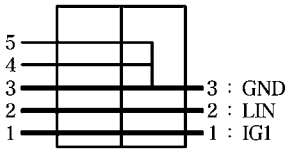
Figure 12:
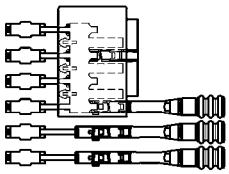
Figure 12:
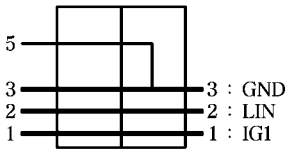
Figure 12:
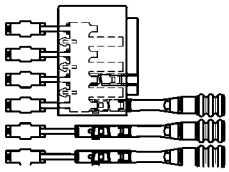
Figure 12:
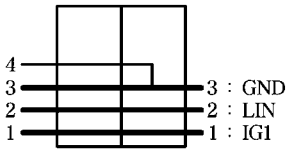
Figure 12:
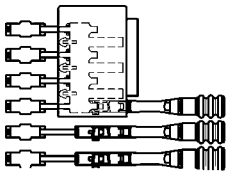
Figure 12:
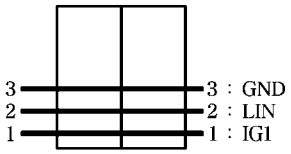

FIG. 12 illustrates examples in which the grounding pattern of the sensor 10 connected to the connector 100 is variously changed as the number and installation position of the first female terminals 120 assembled in the first terminal holder 140 are changed.

In FIG. 12, pattern 1 (the same as the example of FIG. 4) is a case in which the first female terminals 120 are installed in three of the terminal grooves 141 of the first terminal holder 140, respectively. Three of the first female terminals 120 coupled to the first terminal holder 140 are connected to one of the second female terminal 133 connected to the grounding wire 33 through the bus bar 160. Therefore, in this case, four of the male terminals 12 of the sensor 10 are connected to three of the first female terminals 120 and one of the second female terminal 133 and thus may be connected to the grounding wire 33.

In FIG. 12, patterns 2, 3, and 5 are cases in which two of the first female terminals 120 are installed at different positions in the first terminal holder 140. In this case, three of the male terminals 12 of the sensor 10 may be connected to one of the grounding wire 33 in different patterns.

In FIG. 12, patterns 4, 6, and 7 are cases in which one of the first female terminal 20 is installed at different positions in the first terminal holder 140. In this case, two of the male terminals 12 of the sensor 10 may be connected to one of the grounding wire 33 in different patterns.

In FIG. 12, pattern 8 is a case in which only the first terminal holder 140 is installed without being installed the first female terminals 120 in the first terminal holder 140. In this case, one of the male terminal 12 of the sensor 10 may be connected to the second female terminal 133 connected to the grounding wire 33.

As such, the connector 100 of the present embodiment may vary the grounding pattern by changing the number and position of the first female terminals 120 installed in the first terminal holder 140, and various patterns of grounding may be implemented even though only one of the grounding wire 33 is connected because the first female terminals 120 installed in the first terminal holder 140 are connected to the second female terminals 133 connected to the grounding wire 33 through the bus bar 160.

When the connector 100 is manufactured, the grounding pattern may be easily changed in a manner of adjusting the number and position of the first female terminals 120 assembled in the plurality of terminal grooves 141 of the first terminal holder 140 and then mounting the first terminal holder 140 to the female housing 110, in such the connector 100, the grounding pattern according to the change in the number and position of the first female terminals 120 may be easily identified by a worker in the assembly process, and even after the manufacturing of the connector 100 is completed, the color of the first terminal holder 140 may be differently manufactured according to the grounding pattern such that the worker may easily identify the grounding pattern. That is, the first terminal holder 140 may be provided in different colors such as red, blue, and yellow according to the grounding pattern.

The connector 100 of the present embodiment may be connected in different grounding patterns to a plurality of sensors 10 installed at various locations for the same use, so that the position of each of the sensors 10 may be easily recognized. For example, when four of parking assist sensors are installed at the front and rear of a vehicle, respectively, as in the example of FIG. 12, the ground patterns are different for the respective connectors 100 connected to the respective parking assist sensors, so that the position of each of the parking assist sensors may be easily recognized.

As described above, because the connector 100 of the present embodiment may implement various grounding patterns even though only one of the grounding wire 33 is connected except for the power wire 31 and the signal wire 32, the number of the wires connected to the connector 100, the number of the wire sealing members 135 installed on the wires, and the number of the first female terminals 120 installed in the first terminal holder 140 may be significantly reduced. Therefore, as compared with a conventional connector, the manufacturing cost may be reduced, the manufacturing process may be simplified, and the workability of the wiring may be improved. Conventionally, because the grounding wires need to be connected to the connector 100 as many as the number of the male terminals 12 of the sensor 10 for grounding, the number of parts is large and the manufacturing process is complicated.

As is apparent from the above, as compared with a conventional connector, a connector according to an embodiment of the disclosure can significantly reduce the number of wires connected to the connector, the number of wire sealing members installed on the wires, and the number of first female terminals installed in a first terminal holder, so that the manufacturing cost can be reduced, the manufacturing process can be simplified, and the workability of the wiring can be improved.

Further, the connector according to an embodiment of the disclosure can vary the grounding pattern by changing the number and position of the first female terminals installed in the first terminal holder, and can implement various patterns of grounding even though only one grounding wire is connected because the first female terminals installed in the first terminal holder are connected to the second female terminals connected to the grounding wire through the bus bar.

While a number of exemplary aspects and embodiments have been discussed above, those of skill in the art will recognize that still further modifications, permutations, additions and sub-combinations thereof of the features of the disclosed embodiments are still possible. It is therefore intended that the following appended claims and claims hereafter introduced are interpreted to include all such modifications, permutations, additions and sub-combinations as are within their true spirit and scope.

The invention claimed is:

1. A connector comprising:

a female housing;

one or more first female terminals installed in the female housing;

a plurality of second female terminals installed side by side with the first female terminals in the female housing and connected to wires;

a first terminal holder having a plurality of terminal grooves configured to allow the one or more first female terminals to be selectively coupled thereto, the first terminal holder being fastened to the female housing when the first female terminals are coupled; and a bus bar installed in the first terminal holder to allow one of the one or more first female terminals installed in the plurality of terminal grooves and the second female terminals to be connected thereto;

wherein each of the first female terminals are configured to enter the terminal grooves from an entry end of the first terminal holder of the female housing, and an end exposed to the outside of the entry end of the first terminal holder is supported on an inner surface of the female housing.

2. The connector according to claim 1, further comprising a second terminal holder installed in the female housing and configured to support the plurality of second female terminals.

3. The connector according to claim 2, wherein the first terminal holder and the second terminal holder are installed side by side and in contact with each other, and one of the plurality of second female terminals connected to the bus bar is installed between the first terminal holder and the second terminal holder.

4. The connector according to claim 1, wherein the bus bar comprises:

a plurality of first connection portions elastically deformed in contact with outer surfaces of the first female terminals coupled to the plurality of terminal grooves;

a second connection portion elastically deformed in contact with one of the plurality of second female terminals; and a connection part connecting the plurality of first connection portions and the second connection portions.

5. The connector according to claim 1, wherein each of the first female terminals includes a locking groove caught on and supported by a locking protrusion on an inner surface of each of the terminal grooves.

6. A method of manufacturing the connector according to claim 1, comprising:

installing the bus bar in the first terminal holder;

installing at least one of the first female terminals in at least one of the plurality of terminal grooves of the first terminal holder according to a grounding pattern; and coupling the first terminal holder in which the bus bar and the first female terminals are assembled to the female housing and connecting the bus bar to one of the plurality of second female terminals.

7. The method of manufacturing the connector according to claim 6, wherein the first terminal holder is manufactured in a different color according to the grounding pattern to identify the grounding pattern.

* * * * *